US012741683B2

(12) United States Patent
Stetter et al.

(10) Patent No.: US 12,741,683 B2
(45) Date of Patent: Sep. 22, 2026

(54) SENSOR TO SENSOR EDGE TRAFFIC INFERENCE, SYSTEM AND METHOD

(71) Applicant: KONUX GMBH, Munich (DE)

(72) Inventors: Olav Stetter, Munich (DE); Ole Vorren, Munich (DE); Andres Hernandez, Edingen-Neckarhausen (DE)

(73) Assignee: KONUX GMBH, Munich (DE)

( * ) Notice: Subject to any disclaimer, the term of this patent is extended or adjusted under 35 U.S.C. 154(b) by 788 days.

(21) Appl. No.: 18/042,536

(22) PCT Filed: Aug. 25, 2021

(86) PCT No.: PCT/EP2021/073534
§ 371 (c)(1),
(2) Date: Feb. 22, 2023

(87) PCT Pub. No.: WO2022/043395
PCT Pub. Date: Mar. 3, 2022

(65) Prior Publication Data

US 2023/0331272 A1 Oct. 19, 2023

(30) Foreign Application Priority Data

Aug. 31, 2020 (EP) ..... 20193665
Dec. 4, 2020 (EP) ..... 20212001

(51) Int. Cl.
*B61L 27/53* (2022.01)
*B61L 1/16* (2006.01)
(Continued)

(52) U.S. Cl.
CPC ..... *B61L 27/53* (2022.01); *B61L 1/16* (2013.01); *B61L 1/169* (2013.01);
(Continued)

(58) Field of Classification Search
CPC .. B61L 27/50; B61L 1/16; B61L 1/169; B61L 15/0081; B61L 23/04; B61L 25/02;
(Continued)

(56) References Cited

U.S. PATENT DOCUMENTS 9,684,006 B2 6/2017 Pollack
2009/0326746 A1* 12/2009 Mian ..... B61L 1/168 701/19

(Continued)

FOREIGN PATENT DOCUMENTS

AU 785492 B2 12/2007
CN 204630612 U 9/2015

(Continued)

OTHER PUBLICATIONS

International Search Report dated Dec. 13, 2021 for corresponding International Application No. PCT/EP2021/073534.

(Continued)

*Primary Examiner* — Zachary L Kuhfuss
(74) *Attorney, Agent, or Firm* — Tarolli, Sundheim, Covell & Tummino LLP

(57) ABSTRACT

The invention discloses a system for monitoring a railway network infrastructure, the system comprising: at least one sensor node configured to obtain at least one sensor data; at least one processing component configured to: process the at least one sensor data, and generate at least one processed sensor data; at least one analyzing component configured to generate at least one railway network infrastructure hypothesis based on at least one of: the at least one sensor data, and the at least one processed sensor data. The invention also discloses a method for monitoring a railway network infrastructure, the method comprising: obtaining at least one sensor data from at least one sensor node; processing the at least sensor data to generate at least one processed sensor (Continued)

data; and generating at least one railway infrastructure hypothesis comprising at least one data related to the railway network infrastructure, wherein the at least one railway infrastructure hypothesis is based on at least one of the at least one sensor data, and the at least one processed sensor data.

16 Claims, 2 Drawing Sheets

(51) Int. Cl.

| | |
|---|---|
| ***B61L 15/00*** | (2006.01) |
| ***B61L 23/04*** | (2006.01) |
| ***B61L 25/02*** | (2006.01) |
| ***B61L 27/50*** | (2022.01) |
| ***B61L 27/57*** | (2022.01) |
| ***B61L 27/60*** | (2022.01) |
| ***B61L 27/70*** | (2022.01) |

(52) U.S. Cl.
CPC ..... *B61L 15/0081* (2013.01); *B61L 23/04* (2013.01); *B61L 25/02* (2013.01); *B61L 25/023* (2013.01); *B61L 27/50* (2022.01); *B61L 27/57* (2022.01); *B61L 27/60* (2022.01); *B61L 27/70* (2022.01); *B61L 25/021* (2013.01)

(58) Field of Classification Search
CPC ..... B61L 25/023; B61L 27/53; B61L 27/57; B61L 27/60; B61L 27/70; B61L 25/021
See application file for complete search history.

(56) References Cited

U.S. PATENT DOCUMENTS

| | | | | |
|---|---|---|---|---|
| 2017/0176192 | A1 | 6/2017 | Cardoso | |
| 2017/0313331 | A1* | 11/2017 | Hilleary | B61L 17/02 |
| 2019/0250069 | A1* | 8/2019 | Samadani | G06N 20/00 |
| 2020/0010101 | A1 | 1/2020 | Alessi | |
| 2021/0122402 | A1 | 4/2021 | Böhm | |
| 2021/0300389 | A1 | 9/2021 | McGill | |

FOREIGN PATENT DOCUMENTS

| | | | |
|---|---|---|---|
| CN | 109547938 | B | 8/2020 |
| WO | 2019086095 | A1 | 5/2019 |
| WO | 2019185872 | A1 | 10/2019 |
| WO | 2019185873 | A1 | 10/2019 |
| WO | 2020002018 | A1 | 1/2020 |
| WO | 2020002019 | A1 | 1/2020 |

OTHER PUBLICATIONS

Kücükkececi et al.: Multilevel object tracing in wireless multimedia sensor networks for surveillance applications using graph-based big data; IEEE Access; Digital Object Identifier.
The Non-Final Office Action dated Nov. 19, 2024 in the parallel U.S. Appl. No. 18/042,542.
The extended European Search Report dated Jan. 22, 2026 in the corresponding European Patent Application No. 25205206.3.

* cited by examiner

SENSOR TO SENSOR EDGE TRAFFIC INFERENCE, SYSTEM AND METHOD

RELATED APPLICATIONS

The present application is a U.S. National Stage application under 35 USC 371 of PCT Application Serial No. PCT/EP2021/073534, filed on 25 Aug. 2021, which claims priority to EP patent application No. 20193665.5, filed 31 Aug. 2020, and EP patent application No. 20212001.0, filed 4 Dec. 2020, the entirety of each of which is incorporated herein by reference.

FIELD

The invention lies in the field of monitoring a railway network and particularly in the field of monitoring railway network infrastructures. More particularly, the present invention relates to a system for monitoring a railway network infrastructure, a method performed in such a system and corresponding use of such a system.

BACKGROUND

Sensor Networks constitute pervasive and distributed computing systems and are potentially one of the most important technologies of this century. They have been specifically identified as a good candidate to become an integral part of the protection of critical infrastructures, such as rail infrastructure. Wired sensor systems have been widely used for a long time in Structural health monitoring (SHM). It is noted that wired systems seem to be commonly used at large scales. However, due to their own limitations, this technique requires high cost and complex installation processes that are inconvenient and have led to the adoption of wireless sensor networks (WSNs) as an alternative approach. Besides providing real time monitoring and alert for preventing damage and failure, this technique can improve the decision-making process in maintenance based on failure prediction rather than on routine operations or execution of work after failure. In addition, the lower power consumption and relatively low costs of theses sensors when compared to traditional sensor technology can reduce the impact of damaged or lost equipment.

Moreover, WSNs have proved that they can be used under severe weather conditions, such as strong wind, storms and snow, whilst the wired traditional technique is vulnerable to damage (e.g., corrosion), vandalism (e.g., cut wire), dirt and nature elements. It should be understood that wired traditional technique present a disadvantage with regard to the wiring itself being an additional vulnerability. It is also worth mentioning that WSNs offer many possibilities previously unavailable with traditional sensor technology. In terms of time, the wireless sensing units can be installed with ease and completed in approximately half the time of the wired monitoring system because they require less labor-intensive work and no special care to ensure safe placement of wires on the structure. However, it is preferable to combine periodic visual inspection and a WSN condition monitoring system for maintaining railway structures, as this enables an effective periodic inspection of structures depending on the degree of importance of each monitored component based on the detailed data supplied by the WSN.

The deterioration of rail infrastructure is a significant issue throughout the world. Railway inspection is normally conducted periodically every year or several months. It may take too much time to rapidly detect faults in the track that may cause collapse or huge loss, as is the case in the prompt identification of rail defects. The railway industry needs to improve the process and decision thinking of track maintenance. Hence, condition monitoring of rail infrastructure has become important for setting proper predictive maintenances before defect and failure take place. Structural health monitoring (SHM) has been widely developed over the past decade with many civil engineering applications, such as building, bridge, off-shore structure, in order to enhance the safety and reliability. Condition monitoring can reduce maintenance and its costs by detecting the faults before they can cause damage or prevent rail operations.

In addition, visual inspection requirements can be reduced through automated monitoring. Several sensors may be adopted for railway monitoring such as accelerometers, strain gauges, acoustic emission and inclinometers. Apart from detecting defects in rail infrastructure, other benefits of a monitoring system integrating these sensors are to determine the number of axles, number of trains, their speed, acceleration and weight, which are important for adequate management.

Further, the installation of these wireless sensing units can be optimized using the knowledge of network topology.

For example, US20170176192A1 discloses communication network architectures, systems and methods for supporting a network of mobile nodes. As a non-limiting example, various aspects of this disclosure provide communication network architectures, systems, and methods supporting the collection of various kinds of data by mobile and fixed nodes and user devices operating in a geographic area, and the extrapolation from that data of information having significant value to various organizations operating in the geographic area.

U.S. Pat. No. 9,684,006B2 discloses methods and systems for use with an automation system in an automated clinical chemistry analyzer can include one or more surfaces configured to dynamically display a plurality of optical marks, a plurality of independently movable carriers configured to move along surfaces and to observe them to determine navigational information from the plurality of optical marks, and a processor configured to update the plurality of optical marks to convey information that pertains to each respective independently movable carrier. The plurality of marks can include two-dimensional optically encoded marks, barcodes oriented in a direction of travel of the carriers, marks that dynamically convey data, dynamic lines configured to be followed by the carriers, marks indicating a collision zone, or dynamic marks displayed at a location coincident with the location of a pipette.

SUMMARY

In light of the above, it is an object of the present invention to overcome or at least alleviate the shortcomings of the prior art. More particularly, it is an object of the present invention to provide an efficient sensor monitoring system and method for an automatic sensor to sensor edge traffic inference.

It should be understood that the term "edge" is intended to refer to "edge" as given by a graph, implying data related to points between nodes and/or sensors. It should also be understood that the term "traffic" is intendent to refer to any type of data that may be collected for the edge.

In a first aspect, a system for monitoring a railway network infrastructure, the system comprising: at least one sensor node configured to obtain at least one sensor data, at least one processing component configured to: process the at least one sensor data, and generate at least one processed sensor data; at least one analyzing component configured to generate at least one railway network infrastructure hypothesis based on at least one of: the at least one sensor data, and the at least one processed sensor data.

The at least one processing component may be configured to retrieve at least one user data from at least one user device.

The system may comprise at least one server. The at least one server may comprise at least one storage component.

The at least one processing component and the at least one sensor node may be integrated in a single unit.

The at least one user device may be configured to be in a proximity of the at least one sensor node, wherein the proximity may comprise a radius of at most 10 km.

In one embodiment, at least two of the at least one sensor node may be arranged between each other least 10 km, preferably at least 20 km, more preferably at least 50 km.

The system may further comprise at least one base station. In one embodiment, the at least one base station may be configured to exchange data with the at least one sensor node. Additionally, or alternatively, the at least one base station may comprise a machine learning architecture. The machine learning architecture may comprise a neural network classifier.

In another embodiment, the at least one base station may further comprise an autoencoder configured to process the at least one sensor data.

Furthermore, the at least one base station may be configured to exchange data with the sensor nodes in a predetermined radius. The pre-determined radius may comprise a range of up to 10 km, such as 1 km to 5 km.

The at least one processing component may be installed at the at least one base station.

Moreover, the at least one user device may be configured to exchange data with the at least one base station.

The sensor nodes may be configured to be installed in a railway infrastructure.

In one embodiment, the at least one analyzing component may be configured to retrieve sensor data from the at least one processing component. Moreover, the at least one analyzing component may be configured to retrieve raw user data from the at least one user device. Additionally, or alternatively, the at least one analyzing component may be configured to retrieve the at least one processed sensor data from the at least one sensor node.

In another embodiment, the at least one analyzing component may be configured to exchange data with the at least one base station. Moreover, the at least one analyzing component may be configured to aggregate data sourced by the at least two of sensor node and/or base station and/or processing component and/or user device.

Furthermore, the at least one processing component and the analyzing component may be integrated in a single unit.

Moreover, the at least one analyzing component may be configured to generate trajectory data based on the at least one sensor data and the at least one processed sensor data. In one embodiment, the at least one analyzing component may be configured to generate trajectory data based on the at least one of user data and raw user data. Additionally or alternatively, the at least one analyzing component may be configured to generate trajectory data based on labelled input data. Furthermore, the at least one analyzing component may be configured to generate trajectory data based on unlabeled input data.

The at least one input data may comprise schedule data. The at least one input data may comprise load data, preferably from the weighing stations.

In a further embodiment, the at least one analyzing component may comprise at least one neural network architecture. The neural network architecture may comprise a deep neural network architecture. Moreover, the neural network architecture may comprise a convolutional neural network architecture. Additionally, or alternatively, the neural network architecture may comprise a residual neural network architecture.

In another embodiment, the at least one analyzing component may further comprise an unsupervised or a semi supervised machine learning component. The machine learning component may comprise the neural network architecture. Moreover, the machine learning component may be configured to generate trajectory data. The trajectory data at least may comprise direction data. Furthermore, the trajectory data may be configured to be generated based on at least frequency data recorded at the at least one sensor node. Additionally, or alternatively, the trajectory data may be predicted based on at least frequency data recorded at the at least one sensor node.

In one embodiment, the at least one sensor data may comprise at least one of: frequency data, acceleration data, acoustic data, pressure data, strain data, humidity data, temperature data, inclination data. The trajectory data may comprise at least one change in direction of a moving object, such as passenger trains, cargos in a railway infrastructure. Moreover, the trajectory data may be predicted based on electric current variation in at the at least one sensor node. The direction data may be predicted based on electric current variation in a point machine. The trajectory data may be configured to be predicted based on the at least one sensor data from the plurality of sensors. Moreover, the trajectory data may be generated based on the at least one sensor data from the plurality of sensor nodes using the time shift method. In some embodiments, the trajectory data may be generated based on user data sensed by the at least one user device.

In one embodiment, the at least one user device may comprise at least one of smart phone and wearable and smart phone application.

In a further embodiment, the at least one analyzing component may be installed to the at least one base station.

Moreover, the machine learning architecture installed at the at least one base station may be further configured to generate at least one AI model, preferably based on the at least one sensor data.

Furthermore, the at least one analyzing component may be configured to generate trajectory data based on the AI model.

The system may comprise a sensor routine module. The sensor routine module may be configured to generate sensor installing data. Sensor installing data may comprise at least one of optimized geographical location for sensor node installment and an optimized number of sensor nodes to be installed. The sensor routine module may be configured to generate sensor activation data. Furthermore, the sensor activation data may comprise at least one of at least an optimized time period the sensor node may be activated for and at least one sensor node to be activated at a predetermined time.

The sensor routine module may be configured to extract the trajectory data from the at least one analyzing component. Moreover, the sensor routine module may be configured to generate at least part of sensor installing data based on trajectory data. The sensor routine module may be configured to generate at least part of sensor activation data based on trajectory data. Additionally, or alternatively, the sensor routine module may comprise the neural network architecture.

The sensor routine module may comprise a self-improving neural network architecture. The sensor routine module generates the at least one of sensor installing data and sensor activation data based on historical data. In one embodiment, the at least one historical data may comprise network topology data, preferably stored at the at least one server.

In a second aspect, the invention relates to a method for monitoring a railway network infrastructure, the method comprising: obtaining at least one sensor data from at least one sensor node, processing the at least sensor data to generate at least one processed sensor data; and generating at least one railway infrastructure hypothesis comprising at least one data related to the railway network infrastructure, wherein the at least one railway infrastructure hypothesis is based on at least one of: the at least one sensor data, and the at least one processed sensor data.

In one embodiment, obtaining the at least one sensor data from the at least one sensor node may comprise: obtaining at least one first sensor data from at least one first sensor node arranged on the railway network infrastructure at a first position, and obtaining at least one second sensor data from at least one second sensor node on the railway network infrastructure at a second position.

Furthermore, processing the at least one sensor data may comprise processing at least one of the at least one first sensor data, and the at least second sensor data.

Moreover, the method may comprise predicting at least one finding for at least one unmonitored railway network infrastructure, wherein the at least one finding may be based on the at least one railway infrastructure hypothesis. In one embodiment, the at least one finding may comprise at least one tonnage data. In another embodiment, the at least one finding may comprise at least one train count data. In a further embodiment, the at least one finding may also comprise at least one axle count data.

In one embodiment, the at least one railway network infrastructure may comprise at least one railway network infrastructure direction, wherein the method may comprise using at least one direction data. Furthermore, the at least one railway network infrastructure may comprise at least one switch.

The at least one railway network infrastructure may comprise at least one track segment.

In one embodiment, the method may comprise automatically retrieving at least one sensor data from at least one sensor processing component.

Moreover, the method may comprise aggregating data obtained by at least two of the at least one sensor node. The method may comprise aggregating data obtained by the at least two of the at least one sensor node with at least one data sourced from at least one of: base station, processing component, and at least one input data, generating at least one aggregated dataset based on at least one of: base station, processing component, and at least one input data.

The method may comprise generating at least one trajectory data based on at least one of: the at least one first sensor data, the at least one second data, the at least one processed sensor data, and the at least one aggregated dataset.

The method may comprise automatically predicting the at least one trajectory data. The method may comprise generating at least one sensor installing data. Moreover, the method may comprise retrieving at least one used data from at least one user device. The method establishing a bidirectionally communication with at least one server.

In one embodiment, the at least one server may comprise at least one storage component.

Furthermore, the at least one user device may be arranged in a proximity of the at least one sensor node, wherein the proximity may comprise a radius of at most 10 km.

The method further may comprise establishing a bidirectional communication with at least one base station. Moreover, the method may comprise exchanging data between the at least one base station and the at least one sensor node. The at least one base station may comprise a machine learning architecture comprising at least one neural network, wherein the method may comprise teaching to the at least one neural network at least one of: the at least one first sensor data, the at least one second data, the at least one processed sensor data, and the at least one aggregated dataset.

The method may comprise exchanging data between the at least one user device and the at least one base station.

In one embodiment, the at least one sensor node may be configured to be installed in a railway infrastructure.

In one embodiment, the method may comprise labelling at least one of: the at least one first sensor data, the at least one second data, the at least one processed sensor data, the at least one aggregated dataset, and the at least one input data. The at least one input data may comprise schedule data. The at least one input data may comprise at least one load data, preferably from the weighing stations.

In one embodiment, the at least one sensor data may comprise at least one of: the at least one first sensor data, and the at least one second sensor data may comprise at least one of frequency data and acceleration data, acoustic data, pressure data, strain data, humidity data, temperature data, and inclination data.

The at least one direction data may comprise at least one data of at least one change in direction of a moving object, such as passenger trains, cargos in a railway infrastructure.

Furthermore, the method may comprise generating at least one AI model based on the at least one sensor data. The least one sensor installing data may comprise at least one of: an optimized geographical location for sensor node installation data, and an optimized number of sensor nodes to be installed.

The method may comprise generating at least one sensor activation data. The at least one sensor activation data may comprise at least one of: at least one optimized time period for activation of the at least one sensor node, and at least one given sensor node to be activated from the at least one senor node, wherein the method may comprise activating the at least one given sensor node at a pre-determined time.

The method may comprise generating the at least one of sensor installing data and the at least one sensor activation data based on at least one historical data. Furthermore, the at least one historical data may comprise network topology data. The at least one historical data may be stored in at least one of the at least one server.

In one embodiment, the method may comprise: obtaining the at least one first sensor data from the at least one first sensor node arranged on the railway network infrastructure the at a first position; processing the at least one first sensor data; obtaining at least one n-th sensor data from at least one n-th sensor node arranged on the railway network infrastructure at n-th position; processing the at least one n-th sensor data; and generating a railway network infrastructure data difference finding, wherein the data difference finding may be based on at least one parameter difference between the at least one first sensor data and the n-th sensor data.

The method may comprise outputting at least one interpreted railway network infrastructure data difference finding, wherein the interpreted railway network infrastructure data may be based on the railway network infrastructure data difference finding.

The method may comprise generating the at least one railway infrastructure hypothesis based on the at least one interpreted railway network infrastructure data difference finding.

The method may comprise predicting the at least one finding for the at least one unmonitored railway infrastructure using the at least one railway infrastructure based on the at least one interpreted railway network infrastructure data difference finding.

The method may comprise automatically aggregating at least one sensor data between at least two sensor nodes.

The method may comprise automatically generating at least one aggregated sensor data based on the at least one sensor data between the at least two sensor nodes.

The method may comprise automatically inferring the at least one finding based on the at least one aggregated sensor data.

In one embodiment, the method may comprise automatically aggregating over time the at least one finding. Furthermore, the method may comprise automatically determining the at least one finding over the at least one track segment connecting at least two of the at least one sensor nodes. Moreover, the method further may comprise using network topology data to determining the at least one finding. This can be particularly advantageous, as tonnage data, train count data and axle count data may be aggregated over time, for instance, by summation over some time unit of for example, but not limited to, a day of two or more sensor nodes, which may be used to determine data of for example a train that passed over track segments connecting the two or more sensor nodes. Furthermore, other data related to network topology may be used, for example, any network topology data comprise by the historical data. In more simple words, tonnage data and/or train count data and/or axle count data may automatically be aggregated over time per sensor node, e.g. sum per day, and this aggregated data may be used with network topology to automatically determine tonnage data and/or train count data and/or axle count data over a track segment connecting the two or more sensor nodes.

In one embodiment, at least two of the at least one sensor node may be arranged between each other at least 10 km, preferably at least 20 km, more preferably at least 50 km.

The method may comprise carrying out the method on the system according to any of the preceding system embodiments.

The approach of the method of the present invention may be particular advantageous, as it may allow to simplify the monitoring process by looking at a plurality of trains instead of single train, and therefore eliminating an obligatory need to perform trajectory calculations.

In a third aspect, a user device comprising: a device processing component, configured to generate at least part of user data; an interface, configured to retrieve at least one user input; and a memory component, configured to store the user input.

The device may be further configured with machine learning techniques, preferably machine learning classifiers. The device may be configured to carry out the steps of the method according to any of the preceding method embodiments. The device may be configured to exchange data with the at least one sensor node, wherein the sensor node may be according to any of the system embodiment.

In a fourth aspect the invention relates to the use of the system as recited herein for carrying out the method as recited herein. In one embodiment, the invention may also comprise the use of the method as recited herein, the device as recited herein and the system as recited herein for generating and analyzing synthetic data.

In a fifth aspect the invention relates to a computer program product comprising instructions, which, when the program is executed by a user device, causes a user device to perform the method as recited, which have to be executed on the at least one user device, wherein the at least one user device is according to the system as recited herein that may comprise a user device that may be compatible to said method. In one embodiment, the invention may related to a computer program product comprising instructions, which, when the program may be executed by a combination of at least one server and user device, cause the at least one server and the at least one user device to perform the method as recited herein, which have to be executed on the at least one server and the user device, wherein the at least one user device and the at least one server may be according to the system as recited herein that may comprise a sever and/or the at least one user device that may be compatible to said method.

In another embodiment, the invention may relate to a computer program product comprising instructions, which, when the program may be executed by at least one server, cause the at least one server to perform the method as recited herein, which have to be executed on the at least one server, wherein the at least one server may be according to the system as recited herein that may comprise at least one server that may be compatible to said method. In a further embodiment, the invention may relate to a computer program product comprising instructions, which, when the program may be executed by a processing component, cause the at least one processing component to perform the method as recited herein, which have to be executed on the at least one processing component, wherein the at least one processing component may be according to the system as recited herein that may comprise a processing component that may be compatible to said method.

The invention s further described with the following numbered embodiments.

Below, system embodiments will be discussed. These embodiments are abbreviated by the letter "S" followed by a number. Whenever reference is herein made to "system embodiments", these embodiments are meant.

S1. A system for monitoring a railway network infrastructure, the system comprising:

at least one sensor node configured to obtain at least one sensor data, at least one processing component configured to
process the at least one sensor data, and
generate at least one processed sensor data;

at least one analyzing component configured to generate at least one railway network infrastructure hypothesis based on at least one of the at least one sensor data, and the at least one processed sensor data.

S2. The system according to the preceding embodiment, wherein the at least one processing component is configured to retrieve at least one user data from at least one user device.

S3. The system according to any of the preceding embodiments, wherein the system comprises at least one server.

S4. The system according to any of the preceding embodiments, wherein the at least one server comprises at least one storage component.

S5. The system according to any of the preceding embodiments, wherein the at least one processing component and the at least one sensor node are integrated in a single unit.

S6. The system according to any of the preceding embodiments, wherein the at least one user device is configured to be in a proximity of the at least one sensor node, wherein the proximity comprises a radius of at most 10 km.

S7. The system according to any of the preceding embodiments, wherein at least two of the at least one sensor node are arranged between each other least 10 km, preferably at least 20 km, more preferably at least 50 km.

S8. The system according to any of the preceding embodiments, wherein the system further comprises at least one base station.

S9. The system according to any of the preceding embodiments, wherein the at least one base station is configured to exchange data with the at least one sensor node.

S10. The system according to any of the preceding embodiments, wherein the at least one base station comprises a machine learning architecture.

S11. The system according to the preceding embodiment, wherein the machine learning architecture comprises a neural network classifier.

S12. The system according to any of the preceding embodiments, wherein the at least one base station further comprises an autoencoder configured to process the at least one sensor data.

S13. The system according to any of the preceding embodiments, wherein the at least one base station is configured to exchange data with the sensor nodes in a predetermined radius.

S14. The system according to the preceding embodiment, wherein the pre-determined radius comprises a range of up to 10 km, such as 1 km to 5 km.

S15. The system according to any of the preceding embodiments, wherein the at least one processing component is installed at the at least one base station.

S16. The system according to any of the preceding embodiments, wherein the at least one user device is configured to exchange data with the at least one base station.

S17. The system according to any of the preceding embodiments, wherein the at least one sensor node is configured to be installed in a railway infrastructure.

S18. The system according to any of the preceding embodiments, wherein the at least one analyzing component is configured to retrieve sensor data from the at least one processing component.

S19. The system according to any of the preceding embodiments, wherein the at least one analyzing component is configured to retrieve raw user data from the at least one user device.

S20. The system according to any of the preceding embodiments, wherein the at least one analyzing component is configured to retrieve the at least one processed sensor data from the at least one sensor node.

S21. The system according to any of the preceding embodiments, wherein the at least one analyzing component is configured to exchange data with the at least one base station.

S22. The system according to any of the preceding embodiments and features of S13 to S16 wherein the at least one analyzing component is configured to aggregate data sourced by the at least two of sensor node and/or base station and/or processing component and/or user device.

S23. The system according to any of the preceding embodiments, wherein the at least one processing component and the analyzing component are integrated in a single unit.

S24. The system according to any of the preceding embodiments, wherein the at least one analyzing component is configured to generate trajectory data based on the at least one sensor data and the at least one processed sensor data.

S25. The system according to any of the preceding embodiments, wherein the at least one analyzing component is configured to generate trajectory data based on the at least one of user data and raw user data.

S26. The system according to any of the preceding embodiments, wherein the at least one analyzing component is configured to generate trajectory data based on labelled input data.

S27. The system according to any of the preceding embodiments, wherein the at least one analyzing component is configured to generate trajectory data based on unlabeled input data.

S28. The system according to the preceding two embodiments, wherein the at least one input data comprises schedule data.

S29. The system according to any of the preceding embodiments, wherein the at least one input data comprises load data, preferably from the weighing stations.

S30. The system according to any of the preceding embodiments, wherein the at least one analyzing component comprises at least one neural network architecture.

S31. The system according to the preceding embodiment, wherein the neural network architecture comprises a deep neural network architecture.

S32. The system according to any of the preceding two embodiments, wherein the neural network architecture comprises a convolutional neural network architecture.

S33. The system according to the preceding three embodiments, wherein the neural network architecture comprises a residual neural network architecture.

S34. The system according to any of the preceding embodiments, wherein the at least one analyzing component further comprises an unsupervised or a semi supervised machine learning component.

S35. The system according to any of the preceding embodiments, wherein the machine learning component comprises the neural network architecture.

S36. The system according to any of the preceding embodiments, wherein the machine learning component is configured to generate trajectory data.

S37. The system according to any of the preceding embodiments, wherein the trajectory data at least comprises direction data.

S38. The system according to any of the preceding embodiments, wherein the trajectory data is configured to be generated based on at least frequency data recorded at the at least one sensor node.

S39. The system according to the preceding embodiments, wherein the trajectory data is predicted based on at least frequency data recorded at the at least one sensor node.

S40. The system according to any of the preceding embodiments, wherein the at least one sensor data comprises at least one of frequency data and acceleration data and acoustic data and pressure data and strain data and humidity data and temperature data and inclination data.

S41. The system according to any of the preceding embodiments, wherein the trajectory data comprises at least one change in direction of a moving object, such as passenger trains, cargos in a railway infrastructure.

S42. The system according to any of the preceding embodiments, wherein the trajectory data is predicted based on electric current variation in at the at least one sensor node.

S43. The system according to any of the preceding embodiments, wherein the direction data is predicted based on electric current variation in a point machine.

S44. The system according to any of the preceding embodiments, wherein the trajectory data is configured to be predicted based on the at least one sensor data from the plurality of sensors.

S45. The system according to any of the preceding embodiments, wherein the trajectory data is generated based on the at least one sensor data from the plurality of sensor nodes using the time shift method.

S46. The system according to any of the preceding embodiments, wherein the trajectory data is generated based on user data sensed by the at least one user device.

S47. The system according to the preceding embodiment, wherein the at least one user device comprises at least one of smart phone and wearable and smart phone application.

S48. The system according to any of the preceding embodiments, wherein the at least one analyzing component is installed to the at least one base station.

S49. The system according to any of the preceding embodiments, wherein the machine learning architecture installed at the at least one base station is further configured to generate at least one AI model, preferably based on the at least one sensor data.

S50. The system according to any of the preceding embodiments, wherein the at least one analyzing component is configured to generate trajectory data based on the AI model.

S51. The system according to any of the preceding embodiments, wherein the system comprises a sensor routine module.

S52. The system according to any of the preceding embodiments, wherein the sensor routine module is configured to generate sensor installing data.

S53. The system according to the preceding embodiment, wherein sensor installing data comprises at least one of optimized geographical location for sensor node installment and an optimized number of sensor nodes to be installed.

S54. The system according to any of the preceding embodiments, wherein the sensor routine module is configured to generate sensor activation data.

S55. The system according to the preceding embodiment, wherein the sensor activation data comprises at least one of at least an optimized time period the sensor node is activated for and at least one sensor node to be activated at a pre-determined time.

S56. The system according to any of the preceding embodiments, wherein the sensor routine module is configured to extract the trajectory data from the at least one analyzing component.

S57. The system according to any of the preceding embodiments, wherein the sensor routine module is configured to generate at least part of sensor installing data based on trajectory data.

S58. The system according to any of the preceding embodiments, wherein the sensor routine module is configured to generate at least part of sensor activation data based on trajectory data.

S59. The system according to any of the preceding embodiments, wherein the sensor routine module comprises the neural network architecture.

S60. The system according to any of the preceding embodiments, wherein the sensor routine module comprises a self-improving neural network architecture.

S61. The system according to any of the preceding embodiments, wherein the sensor routine module generates the at least one of sensor installing data and sensor activation data based on historical data.

S62. The system according to the preceding embodiment, wherein the at least one historical data comprises network topology data, preferably stored at the at least one server.

Below, method embodiments will be discussed. These embodiments are abbreviated by the letter "M" followed by a number. Whenever reference is herein made to "method embodiments", these embodiments are meant.

M1. A method for monitoring a railway network infrastructure, the method comprising obtaining at least one sensor data from at least one sensor node, processing the at least sensor data to generate at least one processed sensor data; and generating at least one railway infrastructure hypothesis comprising at least one data related to the railway network infrastructure, wherein the at least one railway infrastructure hypothesis is based on at least one of the at least one sensor data, and the at least one processed sensor data.

M2. The method according to the preceding embodiment, wherein obtaining the at least one sensor data from the at least one sensor node comprises obtaining at least one first sensor data from at least one first sensor node arranged on the railway network infrastructure at a first position; and obtaining at least one second sensor data from at least one second sensor node on the railway network infrastructure at a second position.

M3. The method according to any of the 2 preceding embodiments, wherein processing the at least one sensor data comprises processing at least one of the at least one first sensor data, and the at least second sensor data.

M4. The method according to any of the preceding method embodiments, wherein the method comprises predicting at least one finding for at least one unmonitored railway network infrastructure, wherein the at least one finding is based on the at least one railway infrastructure hypothesis.

M5. The method according to the 4 preceding embodiments, wherein the at least one finding comprises at least one tonnage data.

M6. The method according to any of the 5 preceding embodiments, wherein the least one finding comprises at least one train count data.

M7. The method according to any of the 6 preceding embodiments, wherein the least one finding comprises at least one axel count data.

M8. The method according to any of the preceding method embodiments, wherein the at least one railway network infrastructure comprises at least one railway network infrastructure direction, wherein the method comprises using at least one direction data.

M9. The method according to any of the preceding method embodiments, wherein the at least one railway network infrastructure comprises at least one switch.

M10. The method according to any of the preceding method embodiments, wherein the at least one railway network infrastructure comprises at least one track segment.

M11. The method according to any of the preceding method embodiments, wherein the method comprises automatically retrieving at least one sensor data from at least one sensor processing component.

M12. The method according to any of the preceding method embodiments, wherein the method comprises aggregating data obtained by at least two of the at least one sensor node.

M13. The method according to any of the preceding method embodiments, wherein the method comprises aggregating data obtained by the at least two of the at least one sensor node with at least one data sourced from at least one of base station, processing component, and at least one input data, generating at least one aggregated dataset based on at least one of base station, processing component, and at least one input data.

M14. The method according to any of the preceding method embodiments, wherein the method comprises generating at least one trajectory data based on at least one of the at least one first sensor data, the at least one second data, the at least one processed sensor data, and the at least one aggregated dataset.

M15. The method according to the preceding method embodiments, wherein the method comprises automatically predicting the at least one trajectory data.

M16. The method according to any of the preceding method embodiments, wherein the method comprises generating at least one sensor installing data.

M17. The method according to any of the preceding method embodiments, wherein the method comprises retrieving at least one used data from at least one user device.

M18. The method according to the preceding embodiment, wherein the at least one user device is arranged in a proximity of the at least one sensor node, wherein the proximity comprises a radius of at most least 10 km.

M19. The method according to any of the preceding method embodiments, wherein the method establishing a bidirectionally communication with at least one server.

M20. The method according to the preceding embodiment, wherein the at least one server comprises at least one storage component.

M21. The method according to any of the preceding method embodiments, wherein the method further comprises establishing a bidirectional communication with at least one base station.

M22. The method according to preceding embodiment, wherein the method comprises exchanging data between the at least one base station and the at least one sensor node.

M23. The method according to any of the preceding method embodiments and with features of embodiment M21, wherein the at least one base station comprises a machine learning architecture comprising at least one neural network, wherein the method comprises teaching to the at least one neural network at least one of the at least one first sensor data, the at least one second data, the at least one processed sensor data, and the at least one aggregated dataset.

M24. The method according to any of the preceding method embodiments and with feature of embodiment M21, wherein the method comprises exchanging data between the at least one user device and the at least one base station.

M25. The method according to any of the preceding method embodiments, wherein the at least one sensor node is configured to be installed in a railway infrastructure.

M26. The method according to any of the preceding method embodiments, wherein the method comprises labelling at least one of the at least one first sensor data, the at least one second data, the at least one processed sensor data, the at least one aggregated dataset, and the at least one input data.

M27. The method according to any of the preceding method embodiments and with features of embodiment M13, wherein the at least one input data comprises schedule data.

M28. The method according to any of the preceding method embodiments and with features of embodiment M13, wherein the at least one input data comprises at least one load data, preferably from the weighing stations.

M29. The method according to any of the preceding method embodiments, wherein the at least one sensor data comprises at least one of the at least one first sensor data, and the at least one second sensor data comprises at least one of frequency data and acceleration data, acoustic data, pressure data, strain data, humidity data, temperature data, and inclination data.

M30. The method according to any of the preceding method embodiments, wherein the at least one direction data comprises at least one data of at least one change in direction of a moving object, such as passenger trains, cargos in a railway infrastructure.

M31. The method according to any of the preceding method embodiments and with features of embodiment M23, wherein the method comprises generating at least one AI model based on the at least one sensor data.

M32. The method according to any of the preceding method embodiments and with features of embodiment M16, wherein the least one sensor installing data comprises at least one of an optimized geographical location for sensor node installation data, and an optimized number of sensor nodes to be installed.

M33. The method according to any of the preceding method embodiments, wherein the method comprises generating at least one sensor activation data.

M34. The method according to the preceding embodiment, wherein the at least one sensor activation data comprises at least one of at least one optimized time period for activation of the at least one sensor node, and at least one given sensor node to be activated from the at least one senor node, wherein the method comprises activating the at least one given sensor node at a pre-determined time.

M35. The method according to any of the preceding method embodiments, wherein the method comprises generating the at least one of sensor installing data and the at least one sensor activation data based on at least one historical data.

M36. The method according to the preceding embodiment, wherein the at least one historical data comprises network topology data.

M37. The method according to the 2 preceding embodiments and with features of embodiment M18, wherein the at least one historical data is stored in at least one of the at least one server.

M38. The method according to any of the preceding method embodiments, wherein the method comprises obtaining the at least one first sensor data from the at least one first sensor node arranged on the railway network infrastructure the at a first position;

processing the at least one first sensor data;

obtaining at least one n-th sensor data from at least one n-th sensor node arranged on the railway network infrastructure at n-th position;

processing the at least one n-th sensor data; and generating a railway network infrastructure data difference finding, wherein the data difference finding is based on at least one parameter difference between the at least one first sensor data and the n-th sensor data.

M39. The method according to the preceding embodiment, wherein the method comprises outputting at least one interpreted railway network infrastructure data difference finding, wherein the interpreted railway network infrastructure data is based on the railway network infrastructure data difference finding.

M40. The method according to the 2 preceding embodiments, wherein the method comprises generating the at least one railway infrastructure hypothesis based on the at least one interpreted railway network infrastructure data difference finding.

M41. The method according to the 3 preceding embodiments and with features of M4, wherein the method comprises predicting the at least one finding for the at least one unmonitored railway infrastructure using the at least one railway infrastructure based on the at least one interpreted railway network infrastructure data difference finding.

M42. The method according to any of the preceding method embodiments, wherein the method comprises automatically aggregating at least one sensor data between at least two sensor nodes.

M43. The method according to the preceding embodiment, wherein the method comprises automatically generating at least one aggregated sensor data based on the at least one sensor data between the at least two sensor nodes.

M44. The method according to the 2 preceding embodiments, wherein the method comprises automatically inferring the at least one finding based on the at least one aggregated sensor data.

M45. The method according to any of the 3 preceding embodiments, wherein the method comprises automatically aggregating over time the at least one finding.

M46. The method according to the preceding embodiment, wherein the method comprises automatically determining the at least one finding over the at least one track segment connecting at least two of the at least one sensor nodes.

M47. The method according the preceding embodiment, wherein the method further comprises using network topology data to determining the at least one finding.

M48. The method according to any of the preceding method embodiments, wherein at least two of the at least one sensor node are arranged between each other at least 10 km, preferably at least 20 km, more preferably at least 50 km.

M49. The method according to any of preceding method embodiments, wherein the method comprises carrying out the method on the system according to any of the preceding system embodiments.

Below, device embodiments will be discussed. These embodiments are abbreviated by the letter "D" followed by a number. Whenever reference is herein made to "device embodiments", these embodiments are meant.

D1. A user device comprising:

a device processing component, configured to generate at least part of user data;

an interface, configured to retrieve at least one user input; and a memory component, configured to store the user input.

D2. The device according to any of the preceding embodiments, wherein the device is further configured with machine learning techniques, preferably machine learning classifiers.

D3. The device according to any of the preceding device embodiments, wherein the device is configured to carry out the steps of the method according to any of the preceding method embodiments.

D4. The device according to any of the preceding device embodiments, wherein the device is configured to exchange data with the at least one sensor node, wherein the sensor node is according to any of the system embodiment.

Below, use embodiments will be discussed. These embodiments are abbreviated by the letter "U" followed by a number. Whenever reference is herein made to "use embodiments", these embodiments are meant.

U1. Use of the system according to any of the preceding system embodiments for carrying out the method according to any of the preceding method embodiments.

U2. Use of the method according to any of the preceding method embodiments, the device according to any of the preceding device embodiments and the system according to any of the preceding system embodiments for generating and analyzing synthetic data.

Below, program embodiments will be discussed. These embodiments are abbreviated by the letter "P" followed by a number. Whenever reference is herein made to "program embodiments", these embodiments are meant.

P1. A computer program product comprising instructions, which, when the program is executed by a user device, causes a user device to perform the method steps according to any method embodiment, which have to be executed on the at least one user device, wherein the at least one user device is according to any system embodiment that comprises a user device that is compatible to said method embodiment.

P2. A computer program product comprising instructions, which, when the program is executed by a combination of at least one server and user device, cause the at least one server and the at least one user device to perform the method steps according to any method embodiment, which have to be executed on the at least one server and the user device, wherein the at least one user device and the at least one server is according to any system embodiment that comprises a sever and/or the at least one user device that is compatible to said method embodiment.

P3. A computer program product comprising instructions, which, when the program is executed by at least one server, cause the at least one server to perform the method steps according to any method embodiment, which have to be executed on the at least one server, wherein the at least one server is according to any system embodiment that comprises at least one server that is compatible to said method embodiment.

P4. A computer program product comprising instructions, which, when the program is executed by a processing component, cause the at least one processing component to perform the method steps according to any method embodiment, which have to be executed on the at least one processing component, wherein the at least one processing component is according to any system embodiment that comprises a processing component that is compatible to said method embodiment.

BRIEF DESCRIPTION OF THE DRAWINGS

The present invention will now be described with reference to the accompanying drawings, which illustrate embodiments of the invention. These embodiments should only exemplify, but not limit, the present invention.

DETAILED DESCRIPTION OF THE DRAWINGS

In the following description, a series of features and/or steps are described. The skilled person will appreciate that unless explicitly required and/or unless requires by the context, the order of features and steps is not critical for the resulting configuration and its effect. Further, it will be apparent to the skilled person that irrespective of the order of features and steps, the presence or absence of time delay between steps can be present between some or all of the described steps.

It is noted that not all the drawings carry all the reference signs. Instead, in some of the drawings, some of the reference signs have been omitted for sake of brevity and simplicity of illustration. Embodiments of the present invention will now be described with reference to the accompanying drawings.

Figure 1:
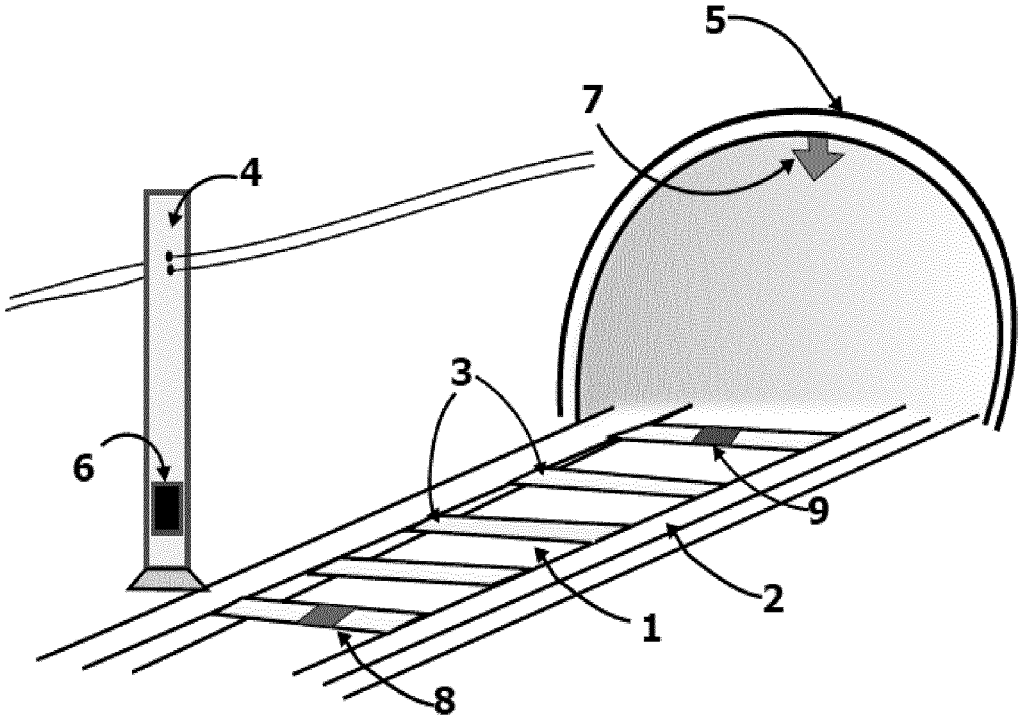
FIG. 1 depicts a sensor node routing in a railway infrastructure according to embodiments of the present invention.

FIG. 1 depicts a sensor node 1-9 routing in a railway infrastructure according to embodiments of the present invention. There is shown an example of a railway section with the railway itself, comprising rails and sleepers. Instead of the sleepers also a solid bed for the rails can be provided. Moreover, a mast that is just one further example of constructional elements that are usually arranged at or in the vicinity of railways. A sensor node 1-9 can be arranged on one or more of the sleepers. The sensor 10 can comprise an acceleration sensor and/or any other kind of railway specific sensor. The sensor node 1-9 can further comprise a wireless sensor network. The sensor node can transmit data to a base station (not shown here). The at least one base station can be installed to the railway infrastructure. The at least one base station can also be installed in the surroundings of the railway infrastructure. The at least one base station can also be a remote base station. The communication module between the at least one base station and the sensor node(s) can comprise, for example Xbee with a frequency of 868 MHz.

The sensor node(s) 1-9 can also be installed in cases and inserted inside the railway infrastructure, for example inside a special hole carved into the concrete. The case can also be attached to the railway infrastructure using fixers. The sensor node 1-9 can be obtaining sensor data based on acceleration, inclination, distance, etc.

The sensor node 1-9 may further be divided into group, for example based on the distance. The sensor node 1-9 lying within a pre-determined distance may be controlled by one base station. The sensor node 1-9 can also be installed on the moving railway infrastructure such as on-board of a vehicle. The sensor node 1-9 can comprise an amplifier to amplify any signal received by the at least one base station.

The sensor nodes 1-9 can be installed such that the sensor node lying within one group can communicate with their base station in one-hop. The at least one base station can receive information from its 'neighbors' and retransmit all the information to the at least one server 800.

The sensor node 1-9 can comprise sensor(s). The sensor can be accelerometers, such as Sensor4PRI for example ADCL 345, SQ-SVS etc. The sensor node 1-9 can comprise inclinometers, such as SQ-SI-360DA, SCA100T-D2, ADXL345 etc.

The sensor node can further comprise distance sensors. The distance sensors can be configured to at least measure the distance between slab tracks, using infrared and/or ultrasonic. The distance sensor can be for example, MB1043, SRF08, PING, etc.

The sensor node 1-9 can comprise visual sensors, such as 3D cameras, speed enforcement cameras, traffic enforcement cameras, etc. It may be noted that sensor node 1-9 may comprise sensors to observe the physical environment of the infrastructure the sensor node 1-9 are installed in. For example, temperature sensor, humidity sensor, altitude sensor, pressure sensor, GPS sensor, water pressure sensor, piezometer, multidepth deflectometers (MDD), etc.

The sensor node 1-9 can be installed to the railway structure depending on the sensor. For example, the strain gauge sensor can be most efficient when installed to the rail. The piezometer can be installed to the sub-ballast. The LVDT sensor can be installed to the sleeper. One sensor node 1-9 can be installed to more than one places.

The sensor node 1-9 can be installed according to a protocol based on routing trees to be able to transmit information to the at least one base station. Once the information has been received, the UMTS technology can be used to send sensor data to a remote server 800.

The sensor node 1-9 can comprise an analog-to-digital converter, a micro controller, a transceiver, power and memory. One or more sensor(s) can be embedded in different elements and can be mounted on boards to be attached to the railway infrastructure. The sensor node 1-9 can also comprise materializing strain gauges, displacement transducers, accelerometers, inclinometers, acoustic emission, thermal detectors, among others. The analog signal outputs generated by the sensors can be converted to digital signals that can be processed by digital electronics. The data can then be transmitted to the at least one base station by a microcontroller through a radio transceiver. All devices can be electric or electronic components supported by power supply, which can be provided through batteries or by local energy generation (such as solar panels), the latter mandatory at locations far away from energy supplies.

The at least one sensor data 101 collected from the sensor nodes 1-9 can be transferred to the at least one base station using wireless communication technology such as CAN, FlexRay, Wi-Fi or Bluetooth. For example, the ZigBee network can be advantageous to consumes less power. On the other hand, for transmitting the input 101 data from the at least one base station to the at least one server 800 long-range communication such as GPRS, EDGE, UMTS, LTE or satellite can be used. Due to the short transmission range, communications from sensor nodes may not reach the at least one base station, a problem that can be overcome by adopting relay nodes to pass the data from the sensor nodes 1-9.

Figure 2:
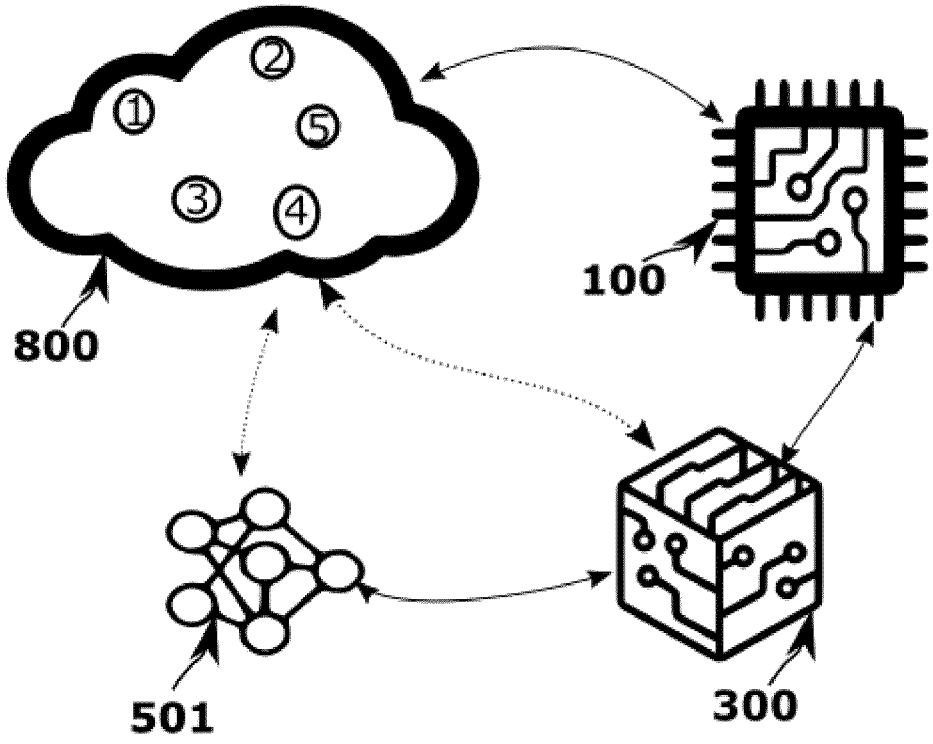
FIG. 2 depicts a system embodiment according to embodiments of the present invention.

FIG. 2 depicts a system according to an aspect of the present invention. The at least one server 800, The collected sensor data 101 can be transmitted to the at least one server 800 server through long-range communications such as GPRS, EDGE, UMTS, LTE or satellite. The sensor node 1-9 can also communicate directly with the at least one server 800 without requiring the use of the at least one base station as a gateway.

The at least one server 800 may comprise a data transmitting component may be configured to establish a bidirectional communication with the at least one base station. In other words, the at least one server 800 may retrieve sensor data 101 from the at least one base station, and further may provide it to the at least one processing component 100, for example, vibrational data.

In one embodiment, the at least one server 800 may comprise a cloud server, a remote server and/or a collection of different type of servers. Therefore, the at least one server 800 may also be referred to as cloud server 800, remote server 800, or simple as servers 500. In another embodiment, the at least one server 800 may also converge in a central server.

It will be understood that the at least one server 800 may also be in bidirectional communication with at least one storage component and an interface component. The storage component may be configured to receive information from the at least one server 800 for storage. In simple words, the storing component 800 may store information provided by the at least one server 800. The information provided by the at least one server 800 may include, for example, but not limited to, data obtained by sensor nodes 1-9, data processed by the at least one processing component 100 and any additional data generated in the at least one server 800 or the at least one processing component 800.

It will be understood that the at least one server 800 may be granted access to the storage component comprising, inter alia, the following dictions about future or otherwise unknown events.

The storage component can comprise comprises a volatile or non-volatile memory, such as a random-access memory (RAM), Dynamic RAM (DRAM), Synchronous Dynamic RAM (SDRAM), static RAM (SRAM), Flash Memory, Magneto-resistive RAM (MRAM), Ferroelectric RAM (F-RAM), or Parameter RAM (P-RAM).

It will also be understood that the term server may also refer to a computer program, and/or a device, and/or a plurality of each or both that may provide functionality for other programs, devices and/or components of the present invention. For instance, at least one server may provide various functionalities, which may be referred to as services, such as, for example, sharing data or resources among multiple clients, or performing computation and/or storage functions. It will further be understood that a single server may serve multiple clients, and a single client may use multiple servers. Furthermore, a client process may run on the same device or may connect over a network to at least one server on a different device, such as a remote server or a cloud. The at least one server may have rather primitive functions, such as just transmitting rather short information to another level of infrastructure, or can have a more sophisticated structure, such as a storing, processing and transmitting unit.

The at least one processing component 100 can comprise a CPU (central processing unit), GPU graphical processing unit), DSP (digital signal processor), APU (accelerator processing unit), ASIC (application-specific integrated circuit), ASIP (application-specific instruction-set processor) or FPGA (field programable gate array) or any combination thereof.

The at least one processing component 100 can further be generating the structured database 103 using the at least one sensor data 101. The structured database 103 may comprise. The at least one processing component 100 can be configured to automatically recognize the sensor associated with the at least one sensor data 101 and can further generate structured database 103 based on the type of the sensor.

The at least one processing component 100 can be configured with machine learning techniques, such as pattern recognition. The at least one processing component can further be configured to generate labeled data using the structured database 103 and/or the at least one sensor data 101.

The processed data, meaning the data transmitting from the at least one processing component 100 which can comprise the structured database and/or the labeled data.

The processed data can be then automatically pulled by the analyzing component 300. The analyzing component 300 can comprise generating trajectory data based on at least the at least one sensor data (temperature, waves, speed, etc.).

The analyzing component 300 may comprise of a computer program product which can be configured to be programmed based on at least one of dynamical systems, statistical models, differential equations, game theoretic models, logic. The analyzing component 300 can be equipped with neural networks. The analyzing component 300 can further be configured to automatically learn the at least one of governing equations, assumptions, constraints using an existing knowledgebase. The analyzing component 300 can also learn using the at least one sensor data and/or user data and/or input data.

The trajectory data generated by the analyzing component 300 can be automatically fed to the sensor routine module 501. The sensor routine module 501 can comprise a machine learning classifier. The sensor routine module 501 may be trained using the trajectory data to generate labeled input data. The sensor routine module 501 can be configured to generate the labeled data by using at least one of k-nearest neighbor, case-based reasoning, artificial neural networks, Naïve Bayes, etc.

The sensor routine module 501 can further be configured to predict at least one infrastructural feature (ballast, frog, geometry, speed, etc.) based on the labeled data and can further transmit the results to a user device.

The at least one user device can comprise a memory component such as, main memory (e.g. RAM), cache memory (e.g. SRAM) and/or secondary memory (e.g. HDD, SDD). The at least one user device 200 may also comprise at least of an output user interface, such as: screens or monitors configured to display visual data (e.g. displaying graphical user interfaces of the questionnaire to the user), speakers configured to communicate audio data (e.g. playing audio data to the user). The at least one user device 200 can also comprise an input user interface, such as, camera configured to capture visual data (e.g. capturing images and/or videos of the user), microphone configured to capture audio data (e.g. recording audio from the user), and a keyboard configured to allow the insertion of text and/or other keyboard commands (e.g. allowing the user to enter text data and/or another keyboard and mouse, touchscreen, joystick-configured to facilitate the navigation through different graphical user interfaces of the questionnaire.

Figure 3:
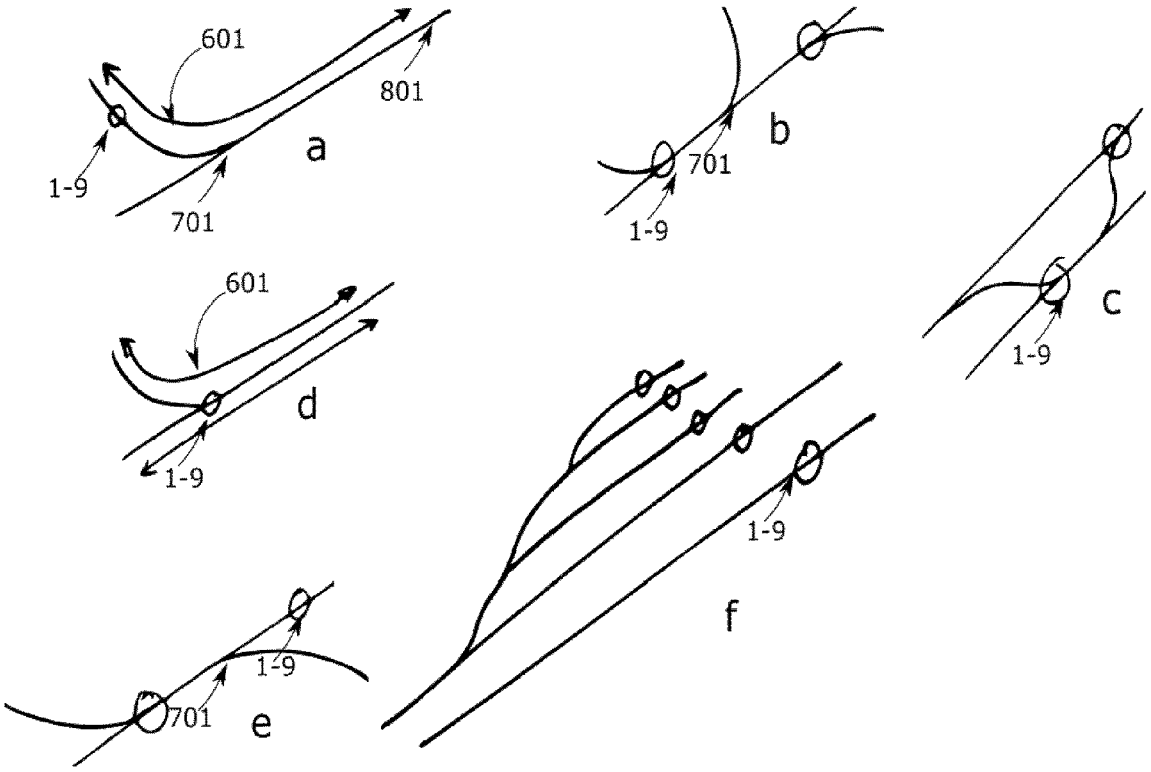
FIGS. 3*a-f* depict an exemplary operation of the system according to embodiments of the present invention.

FIG. 3 shows an exemplary network layout of the sensor nodes 1-9 in a railway infrastructure. The sensor nodes 1-9 can be installed in a proximity of a switch 701 as shown in a, wherein the 601 is a path of a rail vehicle and 801 is a railway track.

In FIG. 3*b, c, d, e* and *f*, respectively, different embodiments related to installation of sensor node 1-9 in proximity of the switch 701 and railway track 801 can be seen. This can facilitate a full coverage of the vehicle path 601.

FIGS. 4A-C schematically depict an exemplary railway network infrastructure according to embodiments of the present invention. In simple terms, FIG. 4A depicts a layout of the sensor nodes 1-9 (not depict inf FIG. 4A) in a railway network infrastructure. The sensor nodes 1-9 may be installed in a proximity of the switch 701 and the railway track 801 is a railway track. In such a layout, it may possible to measure a load on a joint track conceptually identified in FIG. 4A by reference numeral 910. The load on the joint track 910 may, for instance, be measure by of the nodes 1-9, such as a sensor node arranged on the switch 701 (not depict).

Figure 4:
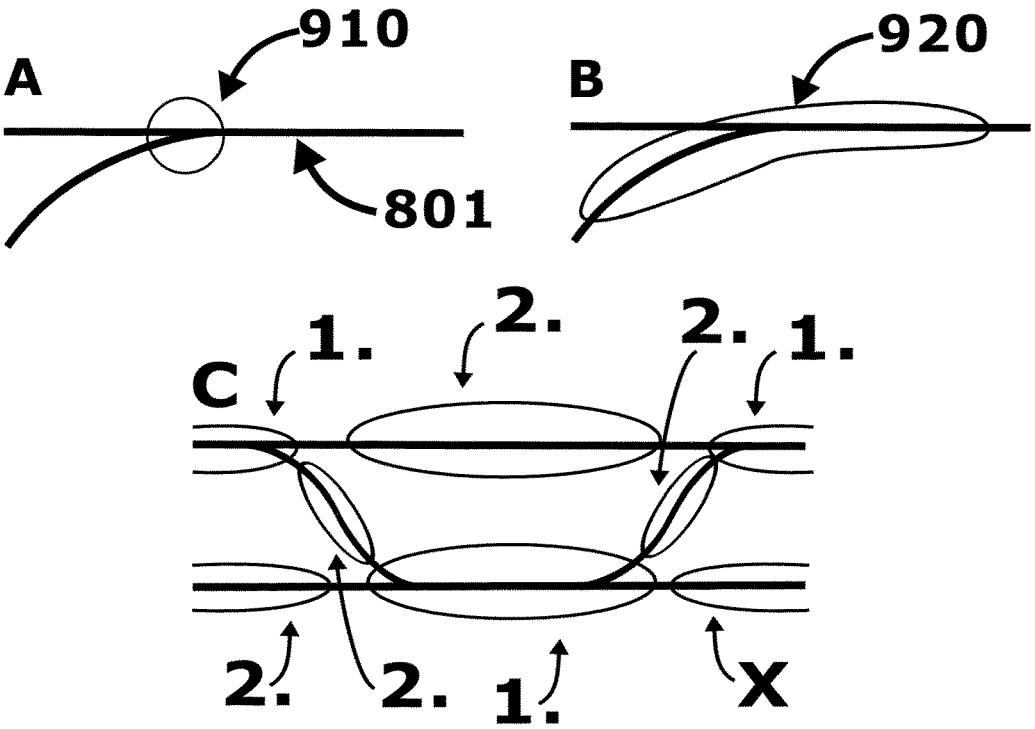
FIGS. 4A-C schematically depict an exemplary railway network infrastructure according to embodiments of the present invention.

Additionally or alternatively, as schematically depicted in FIG. 4B, it may also be possible to know two arms of a switch, as conceptually identified in FIG. 4 B by reference numeral 920. Once two arms 920 are adequately known, it may possible to estimate a third arm, such as for example, via at least one analyzing component and/or processing component. It should be understood that such an approach may also be extended to a plurality of switches comprising at least 3 arms, such for example, comprising at least 5 arms.

Subsequently, it may be possible to implement an approach comprising a higher-order logic as depicted inf FIG. 4C, wherein remaining track segments (1. and/or 2.) may iteratively be estimated based on an assumed known segment X.

Moreover, it should be understood that some segment of the railway infrastructure may be over-determined, so that the current approach may further allow to optimize placement of sensors, which may further facilitate to reduce sensor count while maximizing coverage of the railway infrastructure. Furthermore, individual sensors in combination with the current approach may further provide count as well as other characteristics such as train type of at least one train circulating on the railway network infrastructure, which may further allow a more granular analysis by using the iterative approach described above, which may be implemented for a plurality of individual data sub-category. It should be understood that data estimated for the plurality of individual data sub-category may further be summed up, such for example, via averaging approaches, wherein the summing up may selectively be based on a desired metric.

Additionally or alternatively, the above-described approach may also be combined with a plurality of further approaches, such as, for example, using additional information like schedule, priors in terms of typical train properties e.g. trains tend to go straight whenever possible due to the allowed speeds being higher than on a diverging track, using train trajectory matching and/or making statements about super-segments which may consist of multiple segments. The latter may be particularly advantageous in maintenance cases, where maintenance may often happen on multiple segments simultaneously.

Reference numbers and letters appearing between parentheses in the claims, identifying features described in the embodiments and illustrated in the accompanying drawings, are provided as an aid to the reader as an exemplification of the matter claimed. The inclusion of such reference numbers and letters is not to be interpreted as placing any limitations on the scope of the claims.

The term "at least one of a first option and a second option" is intended to mean the first option or the second option or the first option and the second option.

Whenever a relative term, such as "about", "substantially" or "approximately" is used in this specification, such a term should also be construed to also include the exact term. That is, e.g., "substantially straight" should be construed to also include "(exactly) straight".

Whenever steps were recited in the above or also in the appended claims, it should be noted that the order in which the steps are recited in this text may be accidental. That is, unless otherwise specified or unless clear to the skilled person, the order in which steps are recited may be accidental. That is, when the present document states, e.g., that a method comprises steps (A) and (B), this does not necessarily mean that step (A) precedes step (B), but it is also possible that step (A) is performed (at least partly) simultaneously with step (B) or that step (B) precedes step (A). Furthermore, when a step (X) is said to precede another step (Z), this does not imply that there is no step between steps (X) and (Z). That is, step (X) preceding step (Z) encompasses the situation that step (X) is performed directly before step (Z), but also the situation that (X) is performed before one or more steps (Y1), . . . , followed by step (Z). Corresponding considerations apply when terms like "after" or "before" are used.

The invention claimed is:

1. A system for monitoring a railway network infrastructure, the system comprising at least one sensor node configured to obtain at least one sensor data;

at least one processing component configured to
process the at least one sensor data, and
generate at least one processed sensor data;

at least one analyzing component configured to generate at least one railway network infrastructure hypothesis based on at least one of
the at least one sensor data, and
the at least one processed sensor data; and a sensor routine module configured to
generate at least one sensor installing data, wherein the sensor installing data comprises at least one of
an optimized geographical location for sensor node installment, and
an optimized number of sensor nodes to be installed,
generate at least one sensor activation data, wherein the at least one sensor activation data comprises at least one of
at least one optimized time period the sensor node is activated for, and
at least one given sensor node of the at least one sensor node to be activated at a pre-determined time, wherein the sensor routine module generates at least one of the at least one sensor installing data and the at least one sensor activation data based on at least one historical data.

2. The system according to claim 1, wherein the at least one processing component is configured to retrieve at least one user data from at least one user device configured to be in a proximity of the at least one sensor node.

3. The system according to claim 1, wherein the system comprises at least one server comprising at least one storage component; and at least one base station configured to exchange data with the at least one sensor node, wherein the at least one base station comprises a machine learning architecture.

4. The system according to claim 3, wherein the at least one analyzing component is configured to retrieve raw user data from the at least one user device;

retrieve the at least one processed sensor data from the at least one sensor node;

exchange data with the at least one base station; and aggregate data sourced by the at least two of:

the at least one sensor node, the at least one base station, the at least one processing component, and the at least one user device.

5. The system according to claim 1, wherein the at least one analyzing component is configured to retrieve sensor data from the at least one processing component.

6. A method for monitoring a railway network infrastructure, the method comprising obtaining at least one sensor data from at least one sensor node;

processing the at least one sensor data to generate at least one processed sensor data;

generating at least one railway infrastructure hypothesis comprising at least one data related to the railway network infrastructure, wherein the at least one railway infrastructure hypothesis is based on at least one of the at least one sensor data, and the at least one processed sensor data; and generating at least one sensor installing data and at least one sensor activation data, wherein the at least one sensor installing data comprises at least one of an optimized geographical location for sensor node installation data, and an optimized number of sensor nodes to be installed, wherein the at least one sensor activation data comprises at least one of at least one optimized time period for activation of the at least one sensor node, and at least one given sensor node to be activated from the at least one sensor node, wherein generating at least one of the at least one sensor installing data and the at least one sensor activation data is based on at least one historical data.

7. The method according to claim 6, wherein obtaining the at least one sensor data from the at least one sensor node comprises obtaining at least one first sensor data from at least one first sensor node arranged on the railway network infrastructure at a first position, and obtaining at least one second sensor data from at least one second sensor node on the railway network infrastructure at a second position; and processing the at least one sensor data comprises processing at least one of the at least one first sensor data, and the at least second sensor data.

8. The method according to claim 6, wherein the method comprises predicting at least one finding for at least one unmonitored railway network infrastructure, wherein the at least one finding is based on the at least one railway infrastructure hypothesis; and comprises at least one of tonnage data, train count data, and axle count data.

9. The method according to claim 6, wherein at least one railway network infrastructure comprises at least one railway network infrastructure direction, the method comprising using at least one direction data;

at least one railway network infrastructure comprises at least one switch; and at least one track segment, wherein the method comprises automatically retrieving at least one sensor data from at least one sensor processing component;

aggregating data obtained by the at least two of the at least one sensor node with at least one data sourced from at least one of base station, processing component, and at least one input data; and generating at least one aggregated dataset based on at least one of base station, processing component, and at least one input data.

10. The method according to claim 6, wherein the method comprises retrieving at least one user data from at least one user device;

establishing a bidirectionally communication with at least one server comprising at least one storage component;

establishing a bidirectional communication with at least one base station;

exchanging data between the at least one base station and the at least one sensor node; and exchanging data between the at least one user device and the at least one base station.

11. The method according to claim 6, wherein the at least one base station comprises a machine learning architecture comprising at least one neural network, wherein the method comprises teaching to the at least one neural network at least one of the at least one first sensor data, the at least one second sensor data, the at least one processed sensor data, and the at least one aggregated dataset; and labelling at least one of the at least one first sensor data, the at least one second data, the at least one processed sensor data, the at least one aggregated dataset, and the at least one input data comprising at least one of schedule data, and at least one load data.

12. The method according to claim 6, further comprising activating the at least one given sensor node at the pre-determined time.

13. The method according to claim 6, wherein the method comprises obtaining the at least one first sensor data from the at least one first sensor node arranged on the railway network infrastructure at a first position;

processing the at least one first sensor data;

obtaining at least one n-th sensor data from at least one n-th sensor node arranged on the railway network infrastructure at n-th position;

processing the at least one n-th sensor data;

generating a railway network infrastructure data difference finding, wherein the data difference finding is based on at least one parameter difference between the at least one first sensor data and the n-th sensor data; and outputting at least one interpreted railway network infrastructure data difference finding, wherein the interpreted railway network infrastructure data is based on the railway network infrastructure data difference finding.

14. The method according to claim 13, wherein the method comprises predicting at least one finding for at least one unmonitored railway infrastructure using the at least one railway infrastructure hypothesis based on the at least one interpreted railway network infrastructure data difference finding.

15. The method according to claim 6, wherein the method comprises automatically aggregating at least one sensor data between at least two sensor nodes;

generating at least one aggregated sensor data based on the at least one sensor data between the at least two sensor nodes; and inferring the at least one finding based on the at least one aggregated sensor data.

16. The method according to claim 13, wherein the method comprises automatically aggregating at least one sensor data between at least two sensor nodes;

generating at least one aggregated sensor data based on the at least one sensor data between the at least two sensor nodes; and inferring the at least one finding based on the at least one aggregated sensor data.

* * * * *